US012313070B2

(12) United States Patent
Sinseder et al.

(10) Patent No.: US 12,313,070 B2
(45) Date of Patent: May 27, 2025

(54) ECCENTRIC SCREW PUMP HAVING A STATOR LINKING WHICH IS SIMPLER TO PRODUCE

(71) Applicant: NETZSCH Pumpen & Systeme GmbH, Selb (DE)

(72) Inventors: Dominik Sinseder, Dorfen (DE); Philipp Nübl, Gras Bahnhof (DE); Stefan Weigl, Mühldorf (DE); Stefan Voit, Amerang (DE); Stefan Schöberl, Buchbach (DE); Thomas Schmitt, Lohkirchen (DE)

(73) Assignee: NETZSCH Pumpen & Systeme GmbH, Selb (DE)

( * ) Notice: Subject to any disclaimer, the term of this patent is extended or adjusted under 35 U.S.C. 154(b) by 0 days.

(21) Appl. No.: 18/712,858

(22) PCT Filed: Nov. 18, 2022

(86) PCT No.: PCT/EP2022/082400
§ 371 (c)(1),
(2) Date: May 23, 2024

(87) PCT Pub. No.: WO2023/099240
PCT Pub. Date: Jun. 8, 2023

(65) Prior Publication Data

US 2024/0352931 A1 Oct. 24, 2024

(30) Foreign Application Priority Data

Nov. 30, 2021 (DE) ..... 20 2021 106537.0
Jun. 24, 2022 (DE) ..... 10 2022 115814.4

(51) Int. Cl.
*F04C 2/10* (2006.01)
*F04C 2/107* (2006.01)
*F04C 2/16* (2006.01)

(52) U.S. Cl.
CPC ..... *F04C 2/16* (2013.01); *F04C 2/1075* (2013.01); *F04C 2230/20* (2013.01); *F04C 2240/10* (2013.01)

(58) Field of Classification Search
CPC ..... F04C 2/1075; F04C 2/16
See application file for complete search history.

(56) References Cited

U.S. PATENT DOCUMENTS

2016/0258242 A1* 9/2016 Hayter ..... E21B 34/06
2021/0102464 A1 4/2021 Brice et al.

FOREIGN PATENT DOCUMENTS

DE 3438379 A1 4/1986
DE 102009015024 B3 * 7/2010 ..... F04C 2/1075
EP 3825552 A1 5/2021

OTHER PUBLICATIONS

English translation of DE102009015024 by PE2E, Sep. 11, 2024.*
International Search Report; Application No. PCT/EP2022/082400; Completed: Mar. 9, 2023; Mailing Date: May 11, 2023; 4 Pages.

* cited by examiner

*Primary Examiner* — Deming Wan
(74) *Attorney, Agent, or Firm* — Whitmyer IP Group LLC

(57) ABSTRACT

The invention relates to an eccentric screw pump, including a rotor, which forms a conveying screw, and a stator, which forms a screw flight and in which the rotor rotates during conveying operation, wherein: the stator includes a stator housing, in which a stator lining is disposed, the stator lining reproducing the screw flight; the stator lining is a sleeve which is supported, at its outer periphery, on the stator housing by means of a support structure which forms cavities; the support structure is designed and dimensioned, in accordance with the location of its connection to the (Continued)

sleeve, in such a way that the supporting effect provided by the support structure is matched to the local needs of the sleeve.

20 Claims, 6 Drawing Sheets

ECCENTRIC SCREW PUMP HAVING A STATOR LINKING WHICH IS SIMPLER TO PRODUCE

TECHNICAL FIELD

The invention relates to an eccentric screw pump having a specially designed stator according to the preamble of claim 1 as well as a corresponding stator for installation into its eccentric screw pump, for the purpose of the maintenance thereof or for modernization purposes. The invention likewise relates to a stator lining for an eccentric screw pump according to the preamble of claim 12 as well as a method for producing a stator lining reproducing a screw flight for an eccentric screw pump according to the preamble of the claims.

BACKGROUND

Eccentric screw pumps have a variety of application areas.

Not least, they are a preferred means there for selecting how highly viscous fluids are to be pumped with a consistency, which is difficult to handle and/or with solids contents. For these reasons, eccentric screw pumps are also used in particular when exploiting natural resources.

Eccentric screw pumps are thereby exceptionally well-suited for pumping fluids, which contain abrasive components. They benefit from the fact that the pumping effect of the eccentric screw pump is based on the principle of the moving conveying chambers, which form between the central screw conveyor and the screw flight formed by the stator lining having a double pitch.

It is unavoidable that wear occurs over time on the stator lining, which consists of a material, which is softer compared to the metallic screw.

In most cases, the stator linings currently consist of vulcanized material, such as, for instance, plastic or, if wanting to use the common term, rubber. The material referred to as "rubber" here or material with rubber-like properties, respectively, has the advantage of sealing very well because the contact zone of the screw can continuously displace the contacted stator material more than only microscopically and thus insignificantly. This is a momentary displacement because the stator material (aside from the obligatory smallest wear per cycle) assumes its original shape again, as soon as the local contact with the screw has ended again.

The stator linings are closely matched to the geometries of the screw running therein. In their center, they thus have the highly complex rolling geometry of a screw flight, which winds repeatedly. In the majority of cases, stator linings are thus cast or injected, respectively, to date by using a screw-like mold core, which keeps the clear opening of the screw flight free, which later receives the screw. Upon completion of the injection or casting process, respectively, a vulcanization of the still green stator lining takes place, which was created by means of the casting/injection. Copying methods are also still used, as soon as harder materials are used.

To this day, the "copy turning" of this type still resembles a sophisticated "craftmanship" rather than a fully-automated process as part of an industrial series production.

The harder materials referred to as "rubber" here are not sufficiently resistant in all applications with respect to the fluid to be pumped and, due to their obligatory vulcanization step, they also compel a significant production effort.

For this reason and also in order to be able to streamline the manufacture even more strongly, there is an increasing need for building well-functioning stator linings, which are not dependent on the use of rubber-like materials, but can consist of alternative materials, which, however, do not display a rubber-elastic behavior but are significantly harder or significantly less elastic, respectively, In order to provide stators made of such harder or less elastic materials, respectively, with a comparable for sealing the moving conveyor chambers having a pumping effect, a large shape accuracy of the stator linings has to be ensured—the screw flight has to be embodied as closely as possible to its geometrically optimal shape. Generous tolerances, which are optionally simply compensated in that the screw currently "displaces" slightly more or slightly less of the rubber-like stator material, are not possible.

For this reason, the manufacturing effort during the production of the stator lining from alternative material with the means known today is still quite high, even in light of the fact that at least the time-consuming copying process can be forgone. This is so because the screw flight has to either be produced with extremely accurately by means of machining, grinding and/or eroding or in that a complex injection mold is produced for a start.

SUMMARY

It is accordingly the object of the invention to create an eccentric screw pump having a stator lining, which can be produced even more easily and in the case of which the efficiency can also be improved when using harder stator materials.

The first main claim provides a solution for this object.

It assumes an eccentric screw pump having a rotor forming a screw conveyor and a stator forming a screw flight, in which the rotor revolves during conveying operation. The stator thereby comprises a one- or multi-part stator housing. A stator lining, which reproduces the screw flight, in which the rotor revolves and becomes effective in a pumping manner, is located in said stator housing. The stator housing can be segmented. It can thus optionally consist of several stator housing sections, which are connected in series, together with corresponding stator lining sections, which generally applies for the following statements.

A sleeve made of solid material, i.e., a sleeve having a continuous and thus tightly sealing sleeve wall is a central or essential component of the stator lining. On its outer periphery, this sleeve supports itself on the stator housing via a support structure, which forms macroscopic cavities and, for the most part, accounts at least essentially for the remainder of the stator lining.

According to the invention, the solution proposal is characterized in that, as a function of the location of its connection to the sleeve, the support structure is designed and dimensioned so that the support effect provided by it is matched to the local needs of the sleeve.

It is decisive thereby that the sleeve as such—for the most part aside from its start and end flange—is so "thin-walled" that it can yield reversibly elastically by a certain amount under the local pressure, which the contact zone of the screw, which moves along its inner surface in a "meshing" or "squeezing" manner, respectively, exerts cyclically, in such a way that the required sealing pressure is applied thereby.

The support structure, which is optimized according to the invention, now comes into play at this point. As a function of the location of its connection to the sleeve, said support structure is designed so that the support effect provided by it is matched to the local needs of the sleeve.

For example, the following embodiment means can be used in order to reach the effect according to the invention.

Wall thicknesses, which vary from location to location, can be used.

For instance, an increasing thickness, thus wall thickness or also support force of the support structure, respectively, can thus be provided in the conveying direction, i.e., for the most part in the direction of the straight central longitudinal axis, around which the screw flight formed by the sleeve winds. The higher pressure load appearing at the exit of the screw pump is thus be taken into account.

Viewed along peripheral direction, a larger wall thickness can additionally or alternatively be provided at the location where, for example, the local radial distance, which is to be bridged by means of support, between the sleeve and the stator housing is larger, across which support has to take place.

The degree of the inclination, which influences the local spring effect of the support structure, of the wall forming the support structure can additionally or alternatively be used as embodiment means. This refers to the inclination of the wall with respect to the radial, which protrudes orthogonally to the outside from the stator central line, around which the screw flight formed by the sleeve winds. A wall with an inclination of this type acts, with respect to a compressive stress, which also causes a bending stress therein, imparted thereon by means of the sleeve, in a "softer" or more resilient manner, respectively, than a wall, which is essentially exclusively subjected to pressure.

Alternatively or simultaneously, the local density of the support structure can be varied so that the imparted support effect is matched to the local conditions. It is thus conceivable, e.g., to utilize the option of a cell or even honeycomb-like formation of the support structure, which will be described in more detail later, and to locally vary the cell or honeycomb density. This can take place, for instance, in that the free space, which is surrounded by a cell of this type and which also remains free for the most part, is divided into further smaller cells, in the case of particularly loaded cells, which are written into said (larger) cell.

As a rule, the support by means of the correspondingly designed support structure takes place around or essentially around the entire periphery, 360°. This does not mean that the support structure must not have any interruptions in the peripheral direction.

According to the invention, not only is a support structure provided, which is only relevant to a secondary or tertiary degree with regard to its design, which is of some kind of design and which holds the sleeve forming the screw flight in place in some way, after a fashion, so that a coating with a rubber-elastic material may have to possibly be performed after all on the running surface on the inner surface of the sleeve.

Due to this design, a decreased material volume is sufficient in order to produce the stator lining.

Other material, which do not behave rubber-elastically in terms of a vulcanized material, can simply furthermore partially be used, so that the use thereof becomes practice-oriented for the first time as they can be produced with reasonable effort for the first time. The fact that the support effect can be controlled very delicately via the geometry, the size and the distance of the supporting walls and of the cavities, which are partially or completely delimited thereby, is largely responsible for this. When it is embodied to be thin-walled and is supported according to need, a sleeve made of quite solid or less elastic plastic material, respectively, or even a metal sleeve, can be imparted with the elasticity required for operation. Said metal sleeve is then very thin-walled for the most part and is equipped in a favorable manner only with a wall thickness, which corresponds to maximally four times or three times the largest solid particle, which is to be pumped. In absolute values, wall thicknesses of 0.3 mm to 2.0 mm and even better from 0.4 mm to 0.7 mm are a preferred means of choice for metallic sleeves. A (mostly filigree) support structure made of metal can be molded to the outer periphery of such a metallic sleeve—ideally by means of 3D printing—or a support structure made of plastic can be molded to the metallic sleeve in the same way.

The cavities, which the support structure forms, are macroscopic, not only minimal caverns of a porous material or occasionally shrinkage cavities in the otherwise solid material. Aside from the more or less large microscopic surface roughness, the cavities preferably have a geometrically completely defined design and, in their totality, form a non-random pattern for the most part.

The cavities can optionally be filled completely or partially with a different material, for instance a material serving the purpose of damping.

PREFERRED DESIGN OPTIONS OF THE INVENTION

As independent main claim, but also as further development of the already established claim, it is particularly favorable when the sleeve is thin-walled. In this case, its wall thickness is preferably not more than 1/6, better not more than 1/10 and ideally not more than 1/12 of the average inner radius of the stator housing. A sleeve, which is so thin, does not provide a sufficiently large resistance to the screw of the rotor without support, but behaves almost like a flexible hose. By means of systematic support, the desired flexibility behavior can then be imparted to such a sleeve. This can be attractive when the sleeve consists of a material, which, in itself, is too rigid for the use as stator lining of a screw spindle pump.

It is particularly favorable when the wall thickness of the sleeve is essentially constant.

In other cases, it can be favorable to proceed in a different way. Independent protection is claimed for this purpose, but also protection in further development of the already established claims, the sleeve is also thin-walled here. It is also true, however, that the wall thickness of the sleeve varies locally, preferably by maximally +/−30%, better by maximally +/−20%, ideally by maximally +/−12.5%. Such a design can be useful in order to allow the sleeve to contribute to improving the seal of the region of the screw, which currently meshes with the sleeve, in the regions, in which higher pressures prevail, for instance on the end of the screw flight facing away from the suction side.

In some applications, it can be particularly favorable to produce the support structure from support cells, which each define or enclose a cavity, respectively, wherein the clear cross sectional surface of the cavity enclosed by such a support cell preferably decreases in the radially outward direction. A support of the sleeve, which is resilient in a special way, can be created thereby. This does not apply only, but in particular also when the support cell is filled with a damping material, which finds good support in this way in the support cell, which is open radially on the outer side.

It has turned out to be particularly favorable to realize the support structure with the help of support cells, which form honeycombs, preferably having a hexagonal base surface. A particularly even support can be attained via such support cells, which form honeycombs because the honeycombs form an endless, seamlessly interlocking pattern. The honeycombs additionally also have the advantage that they can optionally not only absorb pressure. Instead, they can also develop a support effect with respect to tensile forces in the longitudinal and peripheral direction, which tend to expand the sleeve. In this respect, the seamless honeycomb mesh then acts like a belt or a flexible belt, respectively.

It is preferably the case that the wall thickness of the support cells corresponds to the average wall thickness of the sleeve (completely or at least at +/−15%, better at least at +/−7.5%). Damaging material accumulations are avoided in this way. The stator lining can also expand evenly under the influence of the unavoidable operational heat-up. Local tensions or even overloads, which can be caused by a thermal excessive preloading with respect to the screw, are avoided.

In some cases, it is particularly favorable when the wall thickness of the support cells increases in the radially outward direction. In this way, a particularly high buckling strength can be ensured in particular at that point where a relatively large distance between the local outer surface of the sleeve and the stator housing is to be bridged.

It has turned out to be particularly favorable when the wall thickness of the support cells increases in the direction of the conveying direction. This is so because the pressure increases significantly due to the pumping effect in the region of the stator end facing away from the suction side. The more intensive support of the sleeve, in particular in the radial direction, then contributes to the fact that the necessary preloading between the sleeve and the screw, which locally meshes along it, is maintained even in this region with a higher load.

It is particularly favorable in some cases when, in the cross section, the walls of the support cells have a central line running from the inside to the outside, which is curved in sections or continuously. Such a curved wall displays a stronger spring effect or resilience, respectively, in the radial direction or from the inside to the outside, respectively, than a wall, which is straight in this direction. This can be used systematically in order to set the locally required spring effect on the construction side.

Alternatively, it has proven itself that, in the cross section, the walls of the support cells have a central line running from the inside to the outside, which is straight and draws an angle with the local tangent of the sleeve. A spring effect, which is stronger in the radial direction or from the inside to the outside, respectively, can also be imparted to the individual support cell in this way. This can also be used in order to set the locally required spring effect on the construction side.

It is particularly favorable when at least the sleeve, preferably the sleeve and the support structure, consists of a non-vulcanized material. Ideally, it is a plastic, which can be processed by means of additive manufacture, ideally a polyamide PA. Alternatively, a metal material, which can be processed by means of additive manufacture, can be considered in some cases.

Under the aspect of the wear reduction and or of the lubrication, it can also be attractive for some applications to use a plastic, which is filled with solid particles, for example metal or ceramic particles, optionally also including particles made of bearing metal, such as, for instance, bearing bronze. Alternatively, a plastic could be attractive, which is filled with particles of a solid lubricant, for instance with MOS2 particles.

It is optionally provided that the sleeve—preferably viewed in the radial direction—is constructed from several different material layers. For example, the outermost layer on the inner surface of the sleeve can thus be a wear protection layer, followed inward towards an adhesion promoting layer, for example.

The rotationally fixed fastening of the stator lining in the stator tube turns out to be particularly easy and reliable when the inner peripheral surface of the stator lining has a polygonal cross section, which corresponds to the cross section of the enveloping surface of the stator lining. Alternatively, a screw-connection of the stator with the adjoining parts is also conceivable.

It is particularly favorable when lubricant is supplied to the inner peripheral surface from the outer peripheral surface of the sleeve, ideally by means of diffusion or compression through the sleeve wall. This is possible in particular in the case of sleeves consisting of plastic, which have been manufactured by way of the 3D printing. The local porosity of the sleeve can be controlled in a very delicate manner in particular by means of the 3D printing or additive manufacturing, respectively. It is possible to provide pores in the sleeve wall at the locations or regions to be lubricated, which are dimensioned so that lubricant can be pushed through the pores from the outside to the inside, without fluid to be pump via the pores to a noteworthy extent being output from the inside to the outside. The latter can be due to the pore size and or the counter-pressure, by means of which the lubricant is guided towards the sleeve from the outside.

A particularly preferred embodiment has a sleeve, which, preferably fastened on its outer peripheral surface, has a sensor, preferably for monitoring the local contour accuracy, deformation and/or the temperature of the sleeve. Several of such sensors are provided for the most part at different locations, which are spaced apart from one another.

As independent main claim, but also as further development of the already established claim, it is particularly favorable when the support structure is designed so that it effects a temperature compensation in such a way that the screw flight formed by the sleeve does not constrict or constricts only less strongly in the case of a heat-up of the support structure. This means that in spite of its support in the stator tube, the support structure is at least designed so that it does not obstruct the expansion of the sleeve, which is caused by a temperature increase of the sleeve, in the radially outward direction or does not obstruct it significantly—so that the sleeve can act or essentially act like a tube, which is not subjected to an expansion obstruction, the clear inside diameter of which increases in response to heat-up, as is well known.

Independent protection is also claimed for the method, which is descried in the claims, for producing a stator lining 20 reproducing a screw flight for an eccentric screw pump. It is characterized in that a sleeve is primarily shaped by means of additive material application, preferably in the radial direction, progressing from the inside to the outside. It reproduces the screw flight. Its outer peripheral surface merges into support cells forming cavities, preferably integrally or integrally printed on, respectively, which support cells are preferably likewise primarily shaped by means of additive material application.

Alternatively, the sleeve is conventionally produced in a non-printing manner by means or original forming and/or re-forming and said support cells, which can thereby optionally be designed in the manner described as part of the invention, are printed on.

The sleeve can thereby be printed from several, different materials in layers, wherein a material, which, compared to steel, has a coefficient of sliding friction, which is decreased compared to the material otherwise used for printing, is preferably used for the radially innermost layer.

It is optionally possible that a different material is entirely, predominantly or essentially used for the walls delimiting the support cells than for printing the sleeve.

Further design options, modes of action and advantages follow from the following description of the exemplary embodiment on the basis of the figures.

DETAILED DESCRIPTION

Figure 1:
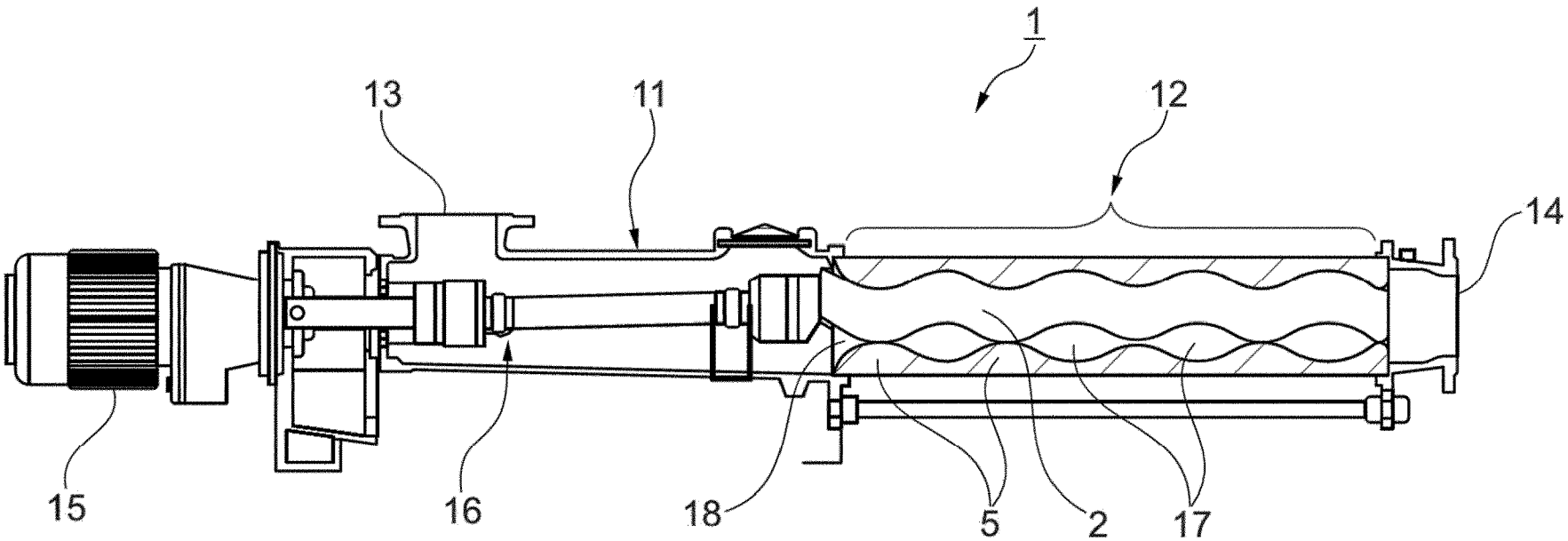
FIG. 1 shows an overview of an eccentric screw pump in general.

FIG. 1 shows the eccentric screw pump 1, which forms the base of the invention, as a whole.

The main components of such an eccentric screw pump 1 are the suction housing 11 and the pump section 12, which is in flow connection therewith.

The inlet 13 for the medium to be conveyed is formed on the suction housing 11.

The conveyed medium is output via the outlet 14, which is arranged on the end of the pump section 12.

The block construction is preferably selected, even if such a block construction is not mandatory with regard to patent law. The pump motor 15 is then flanged to the suction housing 11. The pump motor 15 drives the rotor, which will be described in more detail next, via the mostly gimbal-mounted drive train 16.

The pump section is formed by means of the stator 3 having the rotor revolving therein.

The rotor forms an eccentric screw 2, which can be classified as round threaded screw. Compared to a normal screw, the eccentric screw has a larger pitch, a larger flight depth and a smaller core diameter. The stator 3 consists of a stator lining 20 and a stator tube 5, which receives the stator lining in it. The stator lining is formed complementary to the rotor. It forms a "screw flight", which, however, is equipped with twice the pitch length and an additional thread. Due to this arrangement, a row of conveying chambers 17 is created between the resting stator 3 and the rotor 2, which rotates therewith with eccentric effect and which is also referred to as screw due to its profiling. The conveying chambers 17 move continuously and without change of shape from their entrance side formed by the trumpet 18 on the suction housing 11 to their exit side, i.e., to the outlet 14. The medium located in the conveying chambers 17 is pressurized and conveyed thereby.

The movement speed of the conveying chambers 17 can be controlled via the speed of the rotor in the direction of the exit side and the theoretical pump conveying quantity can thus be controlled.

In addition to the number of the stator windings, the tightness of the contact line between rotor and stator influences the absorption capacity and the conveying pressure of the pump, which can be reached.

Figure 2:
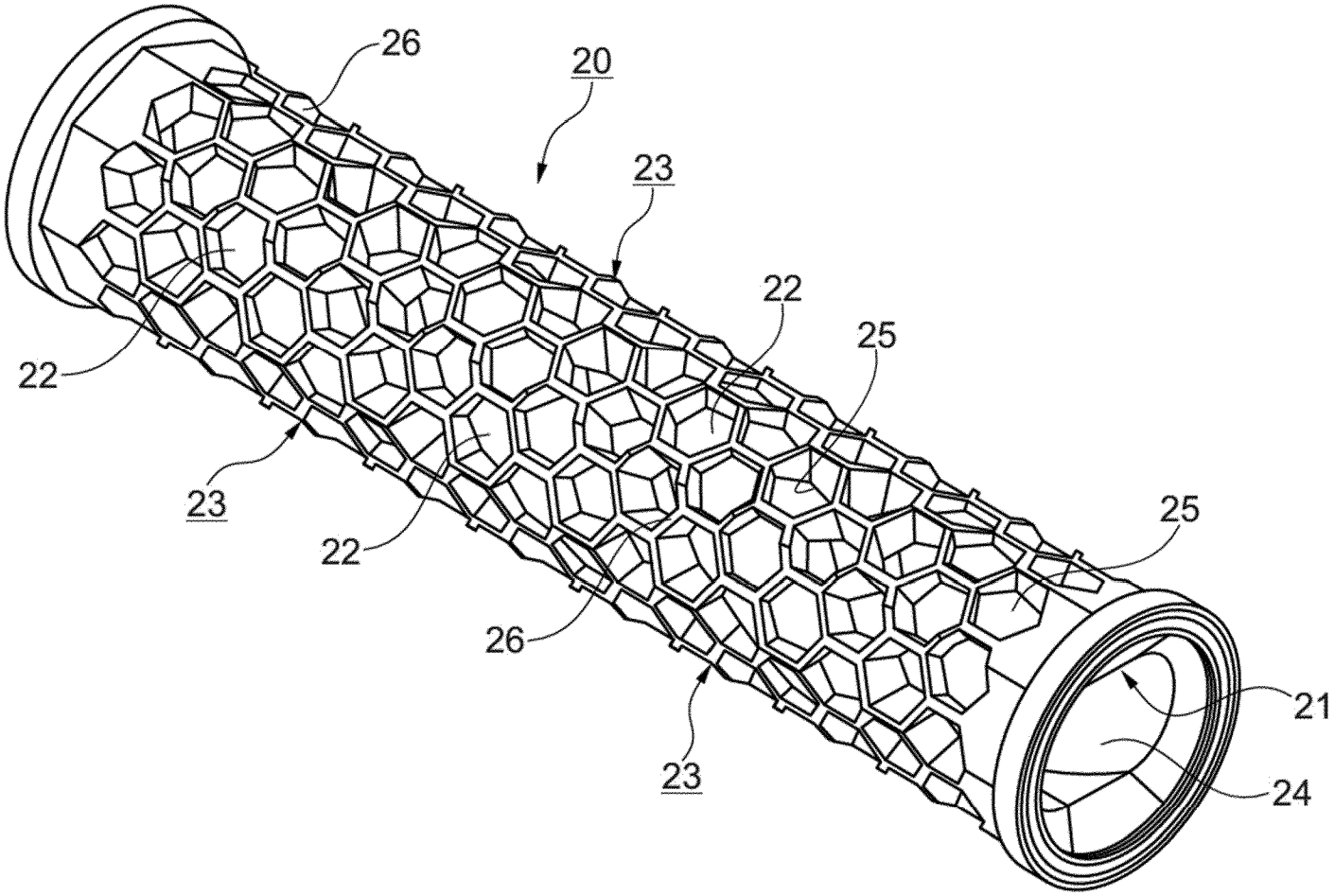
FIG. 2 shows a perspective view of a stator lining of a first exemplary embodiment of the invention.

FIG. 2 shows a stator lining 20 according to a first exemplary embodiment in a perspective manner from the side in overall view. For a better understanding, it is suggested to view this FIG. 2 side by side with FIG. 3. The latter shows a vertical section through the stator lining illustrated by FIG. 2.

Figure 3:
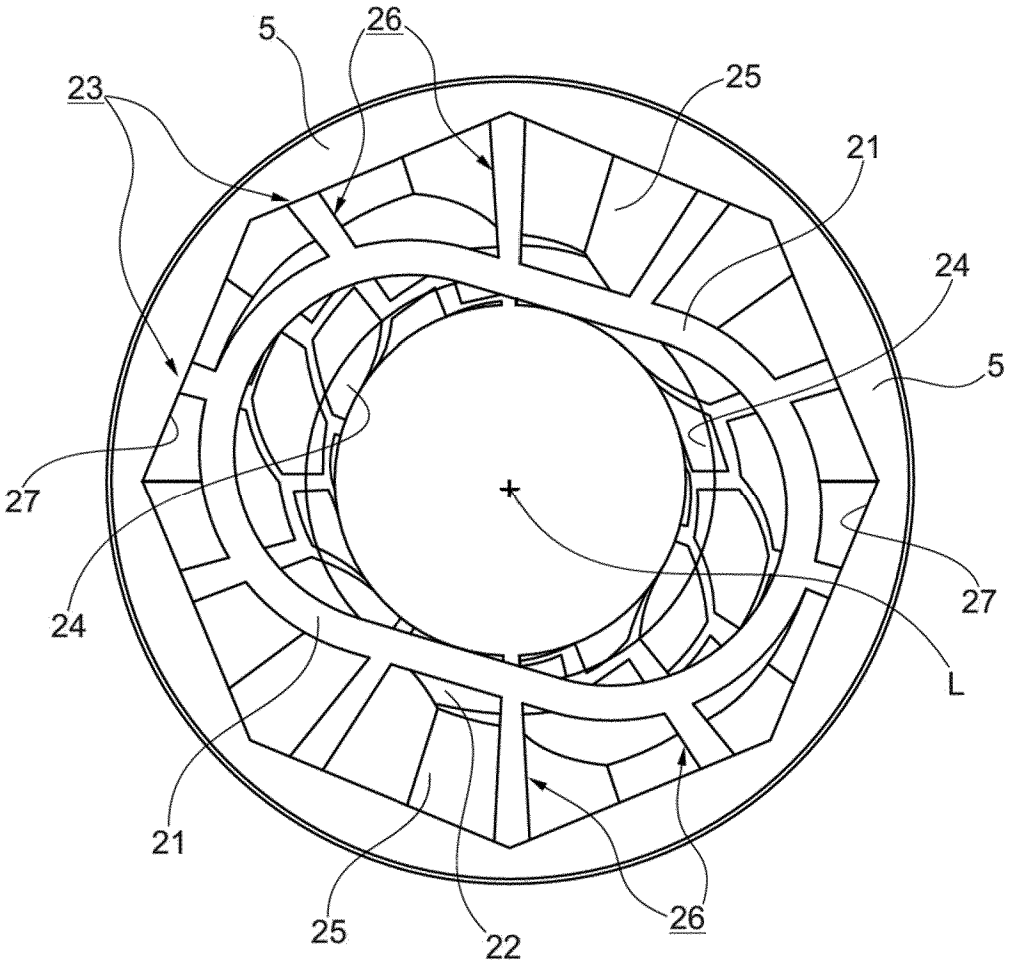
FIG. 3 shows a cross section through the stator lining according to FIG. 2, in a plane perpendicular to the central longitudinal axis, around which the screw flight winds, whereby it is important to note that in reality, when looking into the sleeve 21, the support structure 23 cannot be seen on the smooth inner peripheral surface of said sleeve—only for the sake of clarity, FIG. 3 was drawn here as if the sleeve were transparent.
Figure 4:
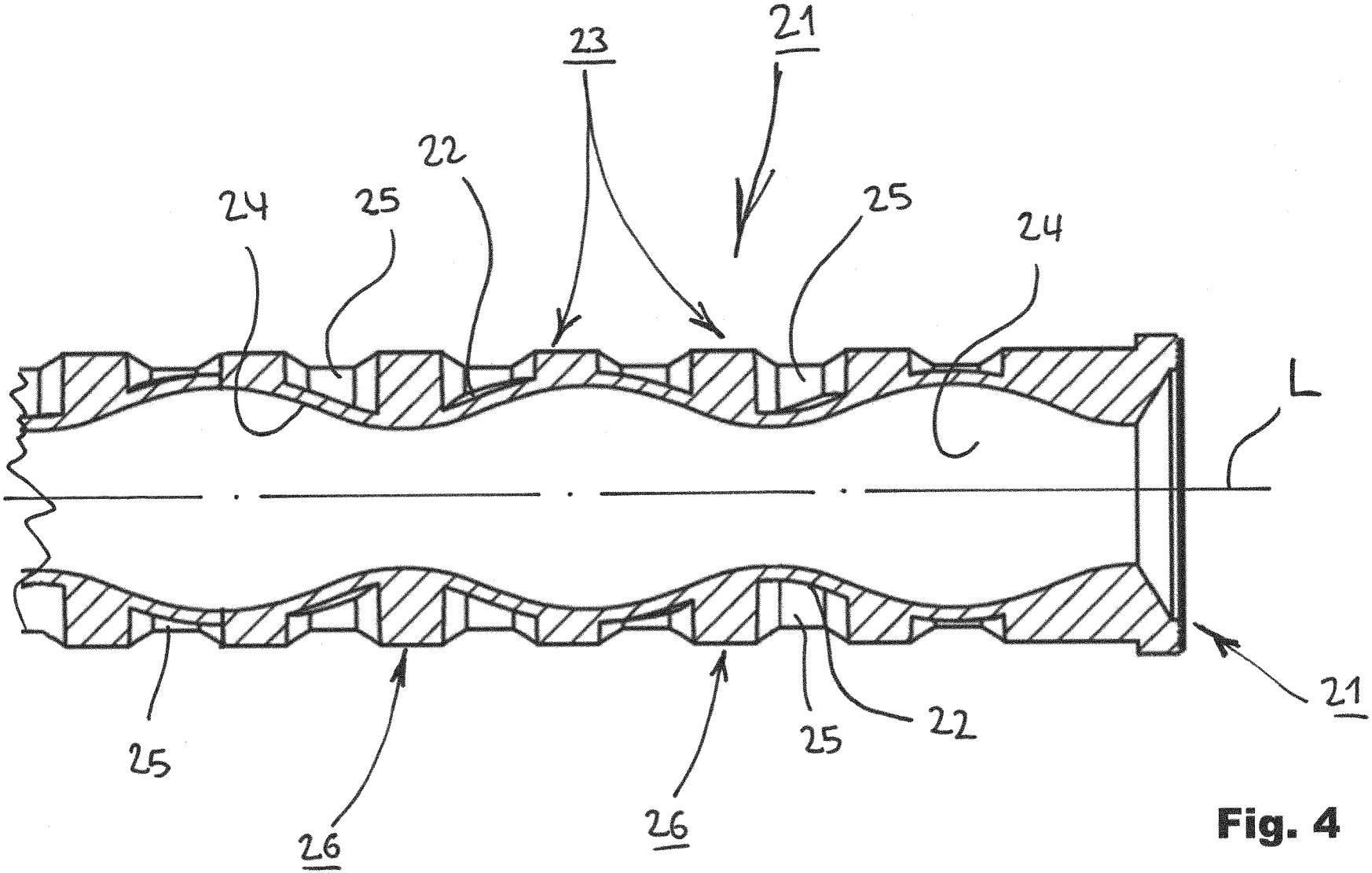
FIG. 4 shows a central longitudinal section through the stator lining according to FIG. 2.

The sleeve 21, which forms the central part of the stator lining 20, can be seen well on the basis of FIG. 3. The sleeve 21 is shaped so that, on its inner surface 24, it represents a screw flight, which is largely matched to the screw 2, which is not illustrated here, which revolves in this screw flight 24 and produces the typical pumping effect of an eccentric screw pump in this way, see also FIG. 1 and the corresponding explanations.

It can be understood well on the basis of FIG. 2 that the topography of the outer peripheral surface 22 of the sleeve 21 reveals the screw-shaped course of the sleeve, which the latter has in its interior.

As can likewise be seen well on the basis of the comparison of FIGS. 2 and 3, a support structure 23, which forms macroscopic cavities 25, adjoins the outer periphery of the sleeve 21 and, as a rule, in integral connection. In the case at hand, the support structure is formed by rings or tube sections 26, respectively. It is particularly favorable that each ring or tube section, respectively, does not only have first wall portions along and second wall portions orthogonally to the central longitudinal axis, around which the screw flight formed by the sleeve winds, but that each ring or tube section also does not only comprise insignificant further wall portions, which run obliquely to said central longitudinal axis.

The tube sections in the form of hexagonal honeycombs, which are used here in the case of this exemplary embodiment, are particularly favorable thereby. Of these honeycombs, each is connected to its immediate neighbors or shares a wall with them, respectively. Each of them is preferably equipped here over the entire length in the radially outward direction with a hexagonal cross section, honeycomb-like rings encloses in its center a macroscopic cavity 25, as has already been mentioned briefly earlier. Each of these honeycomb-like rings abuts on its radially outward, open side against the inner surface of the stator tube, as it is shown by FIG. 3.

Each cavity 25 in the case of the embodiment shown here is thereby in each case completely separated from the adjacent cavities by means of the ring or tube section delimiting it.

Based on this, it can now be understood easily that each of the honeycomb-like rings 26 in each case acts like a support post and thus forms the support structure 23.

It readily makes sense that the support force or spring effect, respectively, of each preferably honeycomb-like ring 26 can be set highly accurately, in that the thickness of its wall is dimensioned accordingly. If the wall thickness becomes larger, the support effect also increases. The volumes of the cavities, which are enclosed by the support structure, then in each case become smaller. That said, it is of interest that the support structure 23 or the honeycomb-like rings thereof, respectively, or the cavities 25 thereof, respectively, have a mathematically describable and thus defined shape. The support effect cannot only be calculated very well in this way but the stator lining 20 can also be produced very well additively, can thus, for example, be manufactured by means of 3D printing.

It goes without saying that it depends on the individual case, how intensively the support structure 23 supports the sleeve 21. The support value TW is the measure for this. It specifies, with how many percent the imaginary jacket surface, which encases the outer periphery of the stator lining, is supported on the stator housing. Meaningful support values TW lie between 20% and 80%, better yet between 30% and 75%.

As can be seen, the wall thickness or average wall thickness W1, W2, Wn, respectively, of the sleeve is small. In the case of this exemplary embodiment, the wall thickness of the thin-walled sleeve 21 is limited to less than one tenth of the radius, which describes the clear opening of the stator housing.

The wall thickness of the sleeve 21 is constant or essentially constant in many cases, as it is also illustrated in FIG. 3. In other cases, it makes sense to allow the wall thickness of the sleeve to vary locally. A maximum variation of plus minus 30% around an average value should not be exceeded in most cases.

As can be seen, the wall thickness of the elements can form the support structure 23, thus, for example, of the honeycomb-like rings 26, which correspond to the wall thickness of the sleeve 21 (completely or essentially). It can be of particular interest here to allow the wall thickness of the rings or tube sections 26, respectively, or of the other elements taking their place, respectively, which form the support structure 23, to increase in the radially outward diction, in order to make the respective elements particularly resistant to kinking. This is so because the bending moment straining them obviously increases from the inside to the outside in the radial direction.

It can also be seen well on the basis of FIG. 3 that the stator housing 5 has a clear cross section on the inside, which is polygonal, ideally octagonal. This thus means that the inner surface of the stator housing 5 running in the peripheral direction is formed by a number of flat surface strips 27, which are arranged at an angle to one another. The elements, which form the support structure 23, are able in this way to support themselves effectively on the inner surface of the stator housing 5, so that the stator lining 20 does in no way also rotate during operation, but always remains stationary.

Figure 5:
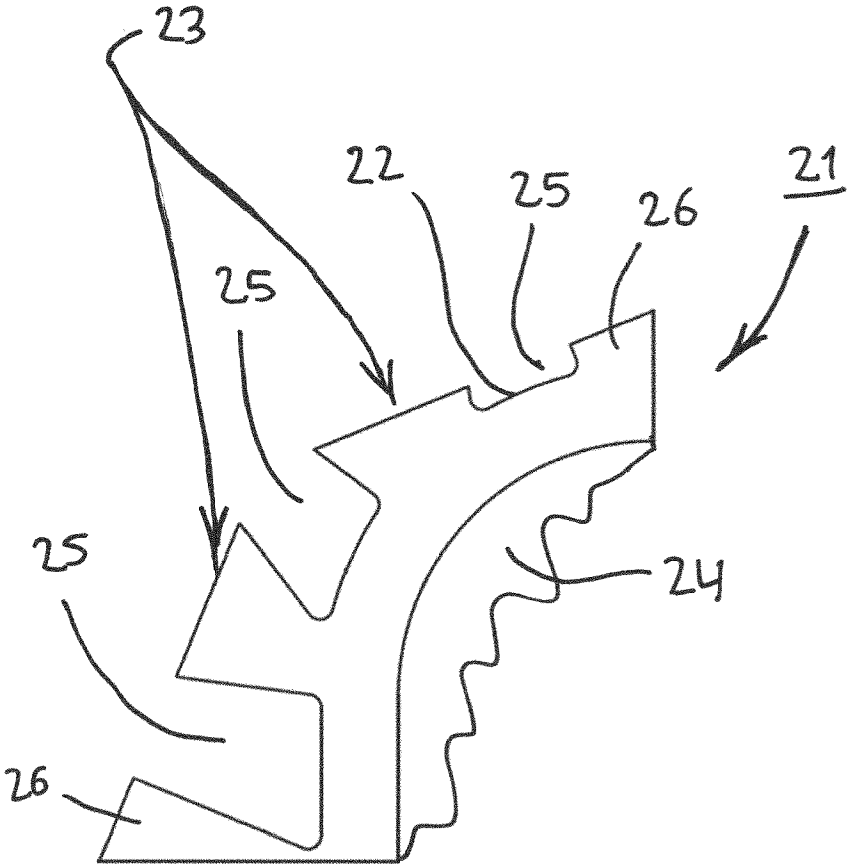
FIG. 5 shows a cut-out of a further stator lining according to a second exemplary embodiment.
Figure 7:
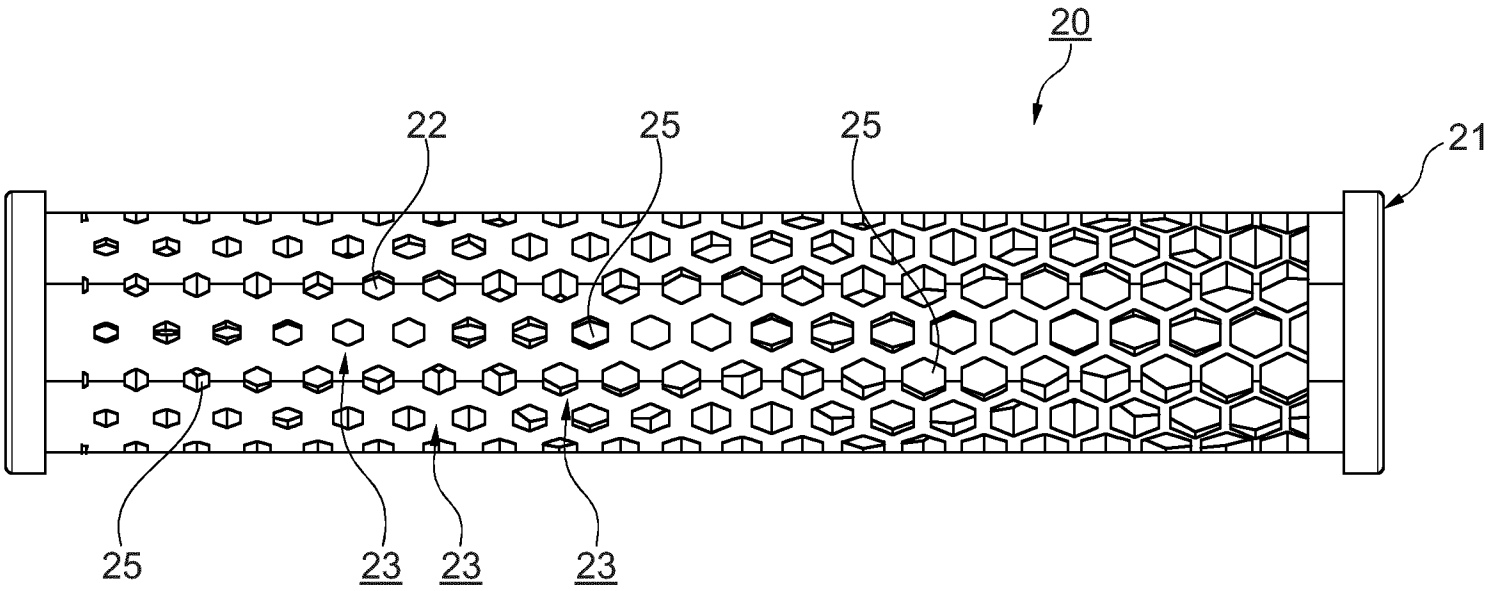
FIG. 7 shows a further exemplary embodiment, in the case of which the wall thickness of the honeycombs forming the support structure increases from the suction side to the pressure side.

FIG. 5 shows a different exemplary embodiment of a stator lining 20 according to the invention.

Here, the stator lining 20 again also comprises a sleeve 21 made of solid material, which holds the fluid to be pumped in the vicinity of the screw in a pressure-tight manner. On its outer periphery, this sleeve also supports itself via a support structure 23, which forms macroscopic cavities 25 and supports itself on the stator housing 5.

It is the case here that the support structure 23 consists of support cells, which are preferably self-contained in their peripheral direction. Here, the cavity 25 in each case also opens out towards the stator housing. It can be seen well on the basis of FIG. 5 that the clear cross sectional surface of the cavity 25, which is enclosed by such a support cell, decreases in the radially outward direction. Viewed in the radially outward direction, the cross sectional surface thus forms an undercut at least in a sectional plane, but mostly all around beyond it.

Figure 6:
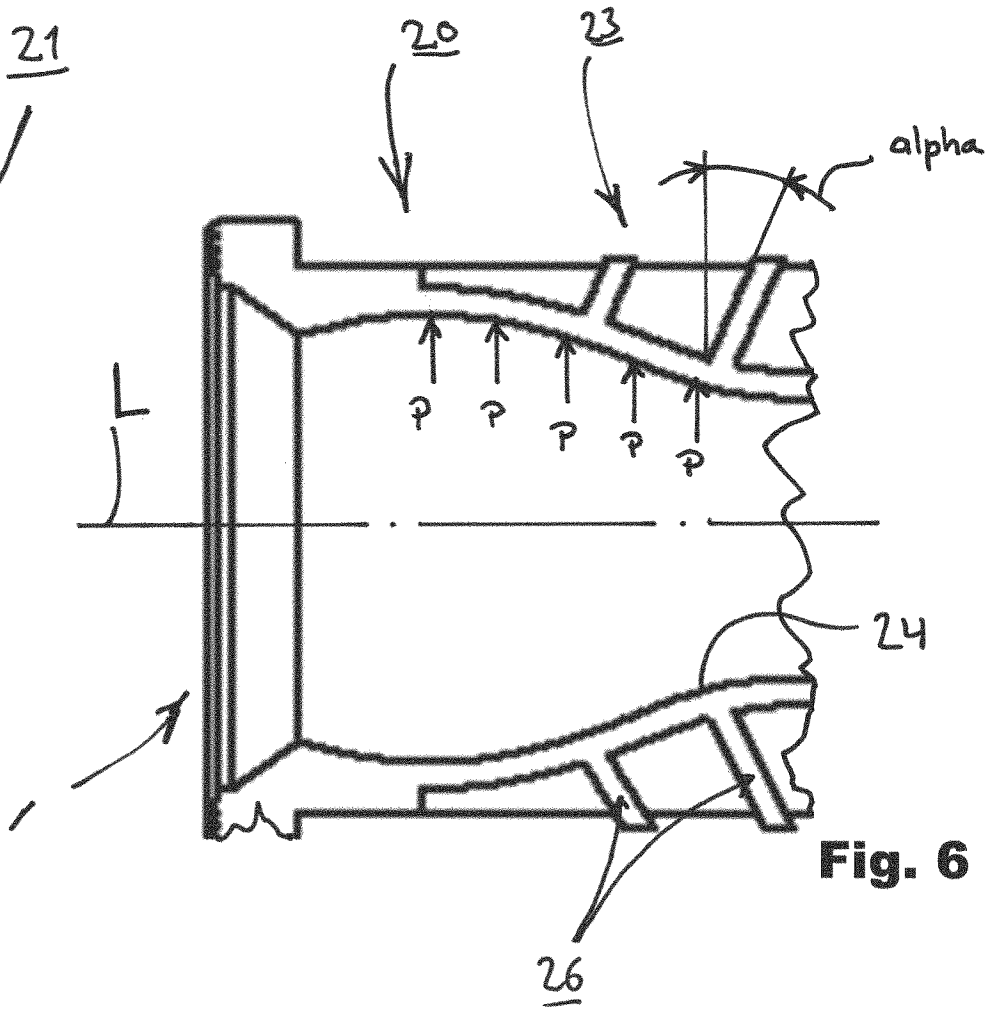
FIG. 6 shows a cut-out of the stator lining, on the basis of which it can be explained why obliquely inclined walls of the support structure make the support characteristic of the support structure softer.

FIG. 6 clarifies an example case, in which the degree of the inclination, which influences the local spring effect of the support structure 23, of the wall, which forms the support structure (23), is used as design means. In contrast to the inner pressure component, which is directed radially to the outside and which is illustrated here by means of the arrows P (already subjected to the resolution of forces), the wall sections of the tube section 26, which can be seen here, are inclined by the angle alpha. They are thus not only loaded by means of compressive forces but also experience a bending moment. The larger the radial inner pressure component and the larger the angle alpha, the stronger the tendency of the bending moment generated thereby to rotate the wall clockwise (on the top side of the shown cut-out) or counter-clockwise (on the bottom side of the shown cut-out). Due to such a rotation, the wall section tends to deflect and thus behaves in a softer, more resilient manner—wherein the resilience is larger, the larger the angle alpha.

Regardless of the claims established so far, but also in combination therewith and/or with other features of this specification, protection is also claimed for an eccentric screw pump having a rotor forming a screw conveyor and a stator forming a screw flight, in which the rotator revolves during conveying operation, wherein the stator comprises a (one- or multi-part) stator housing 5, in which a stator lining 20 is located, which reproduces the screw flight, wherein the stator lining is a sleeve made of solid material, which, on its outer periphery, supports itself on the stator housing via a support structure, which forms macroscopic cavities.

Regardless of the claims established so far, but also in combination therewith and/or with other features of this specification, protection is also claimed for an eccentric screw pump having a rotor forming a screw conveyor and a stator forming a screw flight, in which the rotor revolves during conveying operation, wherein the stator comprises a (one- or multi-part) stator housing, in which a stator lining is located, which reproduces the screw flight, wherein the stator lining is a sleeve made of solid material, which, on its outer periphery, supports itself (essentially or completely) only via its start and end flanges on the stator housing (or is completely self-supporting and thus stator housing-free).

It should likewise be noted very generally that the plastic materials, which are preferably used, are ABS, PE or HDPE, PVC, nylon and polyester, respectively, as well as PP and PET or also PTFE.

It is a very attractive option to provide the stator lining with integrated cooling or heating ducts. Not only the frictional heat developing during operation can be dissipated highly effectively in this way. In contrast, a temperature-guided contour adaptation control is optionally also possible. Heating or cooling can thus be performed systematically, in order to influence the preloading between screw and sleeve as a whole or locally.

The invention further relates to a method for producing the stator of such an eccentric screw pump, as it is discussed here.

Protection is also claimed for a method for producing a stator lining (20) reproducing a screw flight, preferably having one or several features, which claims 1 to 11 disclose for the nature of the stator lining, for an eccentric screw pump 1, characterized in that a sleeve 21 is primarily shaped by means of additive material application (preferably in the radial direction, progressing from the inside to the outside), which reproduces the screw flight and the outer peripheral surface 22 of which merges into support cells forming cavities 25, which are preferably likewise originally shaped by means of additive material application.

Protection is furthermore also claimed for a method for producing an eccentric screw pump having such a stator lining.

It is further advantageous for one of the above-described and/or claimed eccentric screw pumps that the wall thickness of the sleeve 21 is essentially constant.

It is further advantageous for one of the above-described and/or claimed eccentric screw pumps that the topography of the outer peripheral surface 22 of the sleeve 21 shows the screw-shaped course in its interior.

It is further advantageous for one of the above-described and/or claimed eccentric screw pumps that the wall thickness of the support cells increases in the direction of the conveying direction.

It is further advantageous for one of the above-described and/or claimed eccentric screw pumps that, in the cross section, the walls of the support cells have a central line running from the inside to the outside, which is curved.

It is further advantageous for one of the above-described and/or claimed eccentric screw pumps that, in the cross section, the walls of the support cells have a central line running from the inside to the outside, which is straight and draws an angle with the local tangent of the sleeve 21.

It is further advantageous for one of the above-described and/or claimed eccentric screw pumps that at least the sleeve 21, preferably the sleeve 21 and the support structure 23, consists of a non-vulcanized material, preferably a plastic, which can be processed by means of additive manufacture, ideally a polyamide PA or alternatively a metal material, which can be processed by means of additive manufacture.

It is further advantageous for one of the above-described and/or claimed eccentric screw pumps that the sleeve 21 consists of a plastic, which is preferably filled with metal, ceramic or MOS2.

It is further advantageous for one of the above-described and/or claimed eccentric screw pumps that the sleeve 21—preferably viewed in the radial direction—is constructed of several different material layers.

It is further advantageous for one of the above-described and/or claimed eccentric screw pumps that with the radially outward ends of its support structure 23, the stator lining 20 defines an imaginary enveloping surface with polygonal, preferably octagonal cross section.

It is further advantageous for one of the above-described and/or claimed eccentric screw pumps that, preferably fastened to its outer peripheral surface 22, the sleeve 21 has a sensor, preferably for monitoring the contour guidance and/or the temperature.

The invention claimed is:

1. An eccentric screw pump comprising:

a rotor forming a screw conveyor, and a stator forming a screw flight, in which the rotor revolves during a conveying operation, wherein the stator comprises a stator housing and a stator lining located within the stator housing, wherein the stator lining reproduces the screw flight, wherein the stator lining is a sleeve having an outer periphery that is supported on the stator housing via a support structure, the support structure having a plurality of cavities and being connected to the sleeve, the support structure having support cells, each of which defines or encloses, respectively, one cavity of said plurality of cavities, wherein as a function of the location of the connection to the sleeve, the support structure is designed and dimensioned to provide a support effect that is matched to local needs of the sleeve, wherein a wall thickness of the support cells along a longitudinal axis of the stator lining increases in a flow direction from an entrance side of the support structure through to an exit side of the support structure, the increasing wall thickness providing the support effect that is matched to the local needs of the sleeve.

2. The eccentric screw pump according to claim 1, wherein the support effect is matched to the local needs of the sleeve via, when viewed along a peripheral direction, a larger wall thickness that is provided, and/or wherein the support effect is matched to the local needs of the sleeve via a degree of inclination of a wall forming the support structure, the degree of inclination influencing a local spring effect of the support structure, and/or wherein a local density of the support structure is varied so that the support effect imparted is matched to the local needs of the sleeve.

3. The eccentric screw pump according to claim 2, wherein the stator housing is a one-part or multi-part stator housing, wherein the sleeve is made of solid material, and wherein the sleeve is thin-walled and has a wall thickness that varies locally by maximally +/−30%.

4. The eccentric screw pump according to claim 2, wherein the stator housing is a one-part or multi-part stator housing, wherein the sleeve is made of solid material, wherein the support structure comprises support cells, each of which defines or encloses, respectively, one cavity of said plurality of cavities, wherein the one cavity opens out towards the stator housing, and wherein a cross sectional surface of the one cavity enclosed by the support cell decreases in a radially outward direction.

5. The eccentric screw pump according to claim 2, characterized in that lubricant is supplied to the inner peripheral surface from the outer peripheral surface of the sleeve, ideally by means of diffusion or compression through the sleeve wall, for the most part all the way into the region of a lubrication pocket on the inner side.

6. The eccentric screw pump according to claim 2 characterized in that at least locally with respect to other sections of the stator lining, the sleeve is provided with a sleeve wall region having a porosity, which is increased in such a way that lubricant can be pushed through the respective locations, all the way to the inner surface of the sleeve, without the fluid pumped in the opposite direction being able to enter to the outside via the porous inner wall region.

7. The eccentric screw pump according to claim 1, wherein the stator housing is a one-part or multi-part stator housing, wherein the sleeve is made of solid material, and wherein the sleeve is thin-walled having a wall thickness not more than ¼ of an average inner radius of the stator housing.

8. The eccentric screw pump according to claim 1, wherein the stator housing is a one-part or multi-part stator housing, wherein the sleeve is made of solid material, and wherein the sleeve is thin-walled and has a wall thickness that varies locally by maximally +/−30%.

9. The eccentric screw pump according to claim 1, wherein the stator housing is a one-part or multi-part stator housing, wherein the sleeve is made of solid material, wherein the one cavity opens out towards the stator housing, and wherein a cross sectional surface of the one cavity enclosed by the support cell decreases in a radially outward direction.

10. The eccentric screw pump according to claim 9 wherein the support cells form honeycombs or other tube sections, which have a honeycomb structure with resilient and/or damping effect and which ideally form a hexagonal base surface.

11. The eccentric screw pump according to claim 9, wherein the wall thickness of the support cells corresponds to an average wall thickness of the sleeve.

12. The eccentric screw pump according to claim 11, wherein an inner peripheral surface of the stator housing has a polygonal cross section, which corresponds to a cross section of an enveloping surface of the stator lining.

13. The eccentric screw pump according to claim 1, wherein a lubricant is supplied to an inner peripheral surface of the sleeve from an outer peripheral surface of the sleeve, by means of diffusion or compression through a sleeve wall, into a region of a lubrication pocket on an inner side of the sleeve.

14. The eccentric screw pump according to claim 1, wherein at least locally with respect to other sections of the stator lining, the sleeve is provided with a sleeve wall region having a porosity, which is increased in such a way that a lubricant can be pushed through respective locations to an inner surface of the sleeve, without fluid pumped in the opposite direction being able to enter the outside via the sleeve wall region.

15. The eccentric screw pump according to claim 1, wherein the stator housing is a one-part or multi-part stator housing, wherein the sleeve is made of solid material wherein the support structure is designed to effect a temperature compensation in such a way that the screw flight does not constrict or constricts only less strongly during a heat-up of the support structure.

16. The eccentric screw pump according to claim 1, wherein the support structure comprises inclined walls that are oblique relative to a longitudinal axis of the stator lining.

17. A stator lining for an eccentric screw pump having a rotor forming a screw conveyor and a stator forming a screw flight, the rotor being configured to revolve within the stator during conveying operation, the stator including a stator housing, the stator lining configured to be positioned within the stator housing and to reproduce the screw flight, wherein the stator lining comprises a sleeve which has an outer periphery that includes a support structure configured to support the sleeve on the stator housing, the support structure having a plurality of cavities and being connectable to the sleeve, the support structure having support cells, each of which defines or encloses, respectively, one cavity of said plurality of cavities, wherein as a function of the location of the connection to the sleeve, the support structure is designed and dimensioned to provide a support effect that it is matched to local needs of the sleeve, wherein a wall thickness of the support cells along a longitudinal axis of the stator lining increases in a flow direction from an entrance side of the support structure through to an exit side of the support structure, the increasing wall thickness providing the support effect that is matched to the local needs of the sleeve.

18. A method for producing a stator lining, comprising shaping a sleeve by means of additive material application, preferably in an axial direction, from a bottom to a top, which reproduces a screw flight of an eccentric screw pump, wherein an outer peripheral surface of the sleeve merges into support cells integrally forming in cavities, which are shaped by means of additive material application, wherein the support cells collectively provide a support structure, . wherein a wall thickness of the support cells along a longitudinal axis of the stator lining increases in a flow direction from an entrance side of the support structure through to an exit side of the support structure, the increasing wall thickness providing a support effect that is matched to local needs of the sleeve.

19. The method according to claim 18, characterized in that the sleeve is printed in layers of several different materials, wherein one of the materials, which compared to steel or ceramic or compared to a rotor material of the rotor, has a coefficient of sliding friction that is decreased compared to the material otherwise used for printing, wherein said one material is used for the radially innermost layer.

20. The method according to claim 18, characterized in that a different material is used for printing walls delimiting the support cells than for printing the sleeve.

* * * * *